US005626460A

United States Patent [19]

Franke et al.

[11] Patent Number: 5,626,460

[45] Date of Patent: May 6, 1997

[54] CENTRIFUGAL PUMP SYSTEM WITH INTEGRATED HEAT BARRIER

[75] Inventors: Hans-Joachim Franke, Braunschweig; Harald Hartmann, Kindenheim; Roland Lachmayer, Braunschweig, all of Germany

[73] Assignee: KSB Aktiengesellschaft, Frankenthal, Germany

[21] Appl. No.: 613,014

[22] Filed: Mar. 8, 1996

[30] Foreign Application Priority Data

Mar. 9, 1995 [DE] Germany ..... 19508321.0

[51] Int. Cl.[6] ..... F04D 29/58

[52] U.S. Cl. ..... 415/177; 417/373

[58] Field of Search ..... 415/177; 417/373

[56] References Cited

U.S. PATENT DOCUMENTS

| | | | |
|---|---|---|---|
| 3,203,353 | 8/1965 | Ruby . | |
| 3,465,681 | 9/1969 | Zimmermann . | |
| 3,500,754 | 3/1970 | Boes et al. | 417/373 |
| 4,720,248 | 1/1988 | Dernedde et al. | 417/373 |

FOREIGN PATENT DOCUMENTS

| | | |
|---|---|---|
| 2331039 | 6/1973 | Germany . |
| 2748393A1 | 10/1977 | Germany . |
| 2710443A1 | 9/1978 | Germany . |
| 2748393A1 | 5/1979 | Germany . |
| 3016681A1 | 4/1980 | Germany . |
| 3016681C2 | 11/1981 | Germany . |
| 3419678A1 | 5/1984 | Germany . |
| 3440877C2 | 5/1985 | Germany . |
| 3644664C2 | 7/1988 | Germany . |
| 936727 | 9/1963 | United Kingdom . |

OTHER PUBLICATIONS

Dubbel, Taschenbuch Fur Den Maschinenbau, Springer–Verlag, 17. Aufl., 1990, S.E53–E54.

*Primary Examiner*—James Larson
*Attorney, Agent, or Firm*—Darby & Darby

[57] ABSTRACT

A centrifugal pump system for moving hot media includes a pump section, a motor section and mounting elements holding the pump and motor sections together. A force is formed by the mounting elements that is transmitted between the pump section and the motor section. A heat barrier is positioned between the pump section and the motor section. The heat barrier includes an insulating ceramic element. The force transmitted between the pump section and the motor section is transferred through the ceramic element.

13 Claims, 3 Drawing Sheets

CENTRIFUGAL PUMP SYSTEM WITH INTEGRATED HEAT BARRIER

BACKGROUND OF THE INVENTION

1. Field of the Invention

The present invention relates to a centrifugal pump system having an integrated heat barrier. More particularly, the present invention relates to a centrifugal pump having a rigid structure integrated heat barrier which does not include external or internal cooling provisions.

2. Discussion of the Related Art

Conventional centrifugal pumps include heat barriers for providing a means of cooling. An example of such a centrifugal pump is disclosed in German Patent No. DE 3016681 C2. The heat barrier is designed as a subassembly whereby the heat barrier constitutes a structural component having a substantial axial length and is provided with two flange-mounting surfaces, one on the pump side, the other on the motor side. In the area of an impeller drive shaft, the heat barrier is provided with a pressure-resistant junction. Various inserts are positioned between the flanges to transfer the forces between the flange surfaces, while at the same time, their thermally reflective surfaces enable cooling.

The above described heat barrier, while effective in terms of heat attenuation, suffers from the drawback that it has a substantial axial length which negatively affects the vibration characteristics of the overall pump assembly. Further, since the interchangeable heat-attenuating elements of prior art heat barriers are mounted on a considerably smaller diameter than the force-transferring connectors between the pump and motor components and in view of today's significantly greater pump throughput parameters, this type of design negatively affects the vibration characteristics of the pump assembly.

An alternative centrifugal pump design is disclosed in G.B. Patent No. 936,727 in which the intake and output pressure connections are located in direct proximity to the heat barrier and are integrated into the wall separating the pump and motor sections. This results in large metal-to-metal contact surfaces between the pump and motor sections which are connected to one another and with a motor bearing bracket clamped between the pump and motor sections. Further, a disk-shaped space in the partitioning wall incorporating intake and exit connections contains an insulating layer which functions as a heat barrier. However, due to the large metal-to-metal contact surfaces and the inevitably resulting direct heat conduction, this type of heat barrier requires supplementary liquid cooling, which increases the complexity as well as cost of the pump system.

Accordingly, it is an object of the present invention to overcome the above mentioned shortcomings by providing a heat barrier which permits a rigid structural design of a centrifugal pump system without requiring supplemental external or internal cooling provisions.

SUMMARY OF THE INVENTION

The present invention relates to a centrifugal pump system having an integrated heat barrier disposed between the pump section and the motor section. The mounting force transmitted between the pump and motor sections is transferred through a ceramic element of the heat barrier. The heat barrier is disposed in direct proximity to the connecting elements of the pump system. The necessary force-transmitting contact surface between the pump and motor sections is interrupted by the interpositioned, insulating ceramic element. Since there is a straight-line flux of force between the motor and pump sections to be connected, the ceramic element is only exposed to pressure forces. The space between the ceramic element and the shaft passage of the heat barrier is filled with an insulating material, preferably ceramic-based, which, however, has no force-transmitting properties. The insulating material prevents heat conduction, by thermal radiation, to the motor system components (e.g., motor windings, motor housing and a heat bearing component) and to the liquid-containing spaces. The insulating material is preferably fabricated from a pad of ceramic fiber.

The ceramic element utilized in the pump system is preferably of a single-piece or a multi-part design. It is noted that a multi-part ceramic element typically offers greater design flexibility. The ceramic element may consist of several sectional annular elements which, if appropriately shaped, permit their use in various structural sizes. It is equally possible for instance to string a series of small, disk-shaped ceramic elements together into a multi-part, circular ceramic element. In this context, the small ceramic disks can be contoured to permit both easy production and the stringing together of disks into a ring within an area determined by the system design.

BRIEF DESCRIPTION OF THE DRAWINGS

The above and still further, objects, features and advantages of the present invention will become apparent upon consideration of the following detailed description of a specific embodiment thereof, especially taken in conjunction with the accompanying drawings wherein.

DETAILED DESCRIPTION OF THE PREFERRED EMBODIMENTS

Figure 1:
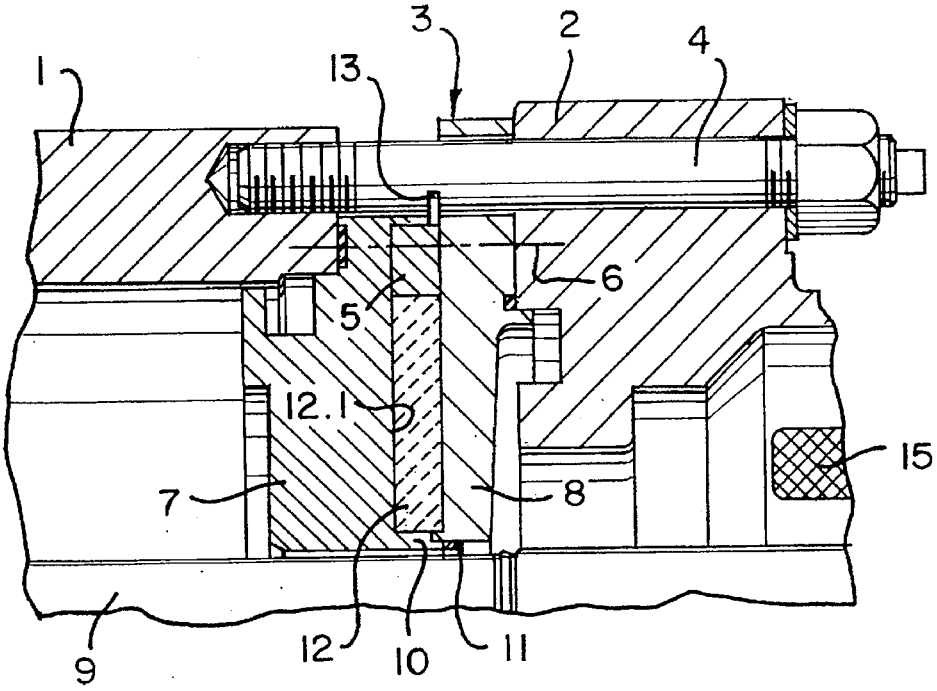
FIG. 1 illustrates a partial cross-sectional view of a heat barrier having a ceramic element provided outside the mounting hardware in accordance with the present invention.

Referring to the drawings in which like reference numerals identify similar or identical elements, FIG. 1 illustrates a heat barrier 3, which is a component of a motor-driven pump system. The heat barrier 3 is positioned between a pump section 1 and a motor section 2. Mounting hardware 4, connects the pump section 1 and motor section 2 together. Mounting hardware 4 is preferably configured as a tie rod and lock nut arrangement. Heat barrier 3 is preferably configured to protect a winding 15 of the motor section 2 from being exposed to heat, which is emitted from pump section 1.

In the preferred embodiment of FIG. 1, heat barrier 3 includes a checkerwork type of ceramic element 5. Ceramic element 5 is disposed between pump section 1 and motor section 2. Therefore, ceramic element 5 is positioned in the straight-line flux of force 6 present between pump section 1 and motor section 2. In other words, the forces transmitted between the pump section 1 and motor section 2 by, for example, hardware 4 is transferred through ceramic element 5. Heat barrier components 7 and 8 protect ceramic element 5 against mechanical damage in the pump system. Heat barrier part components 7 and 8 are preferably configured as metal flanges that are separated by an insulating layer. Further, heat barrier components 7, 8 are in heat-conducting contact only in the area of the shaft 9 where they form a thin, pressure-resistant shaft passage 10. Shaft passage 10 is configured so as to withstand mechanical stress while minimizing thermal conduction. For example, in the area in proximity to shaft passage 10, the two matched heat barrier parts 7 and 8 are seamwelded together so as to be impervious to liquids and gas.

A ceramic fiber material 12 fills the space 12.1 between the insulating, force-transferring ceramic element 5 and shaft passage 10. Ceramic fiber 12 prevents thermal influences from creating additional stress in heat barrier 3 and thermal radiation from transmitting heat to motor 2, ceramic element 5 and heat barrier 8 and to the liquid-containing spaces. In proximity to mounting hardware 4, heat barrier 7 covers ceramic element 5 so as to maintain the position of ceramic element 5. A gap 13 is provided between heat barrier components 7 and 8 radially outside of element 5 to prevent the occurrence of direct heat transfer therebetween.

Figure 2:
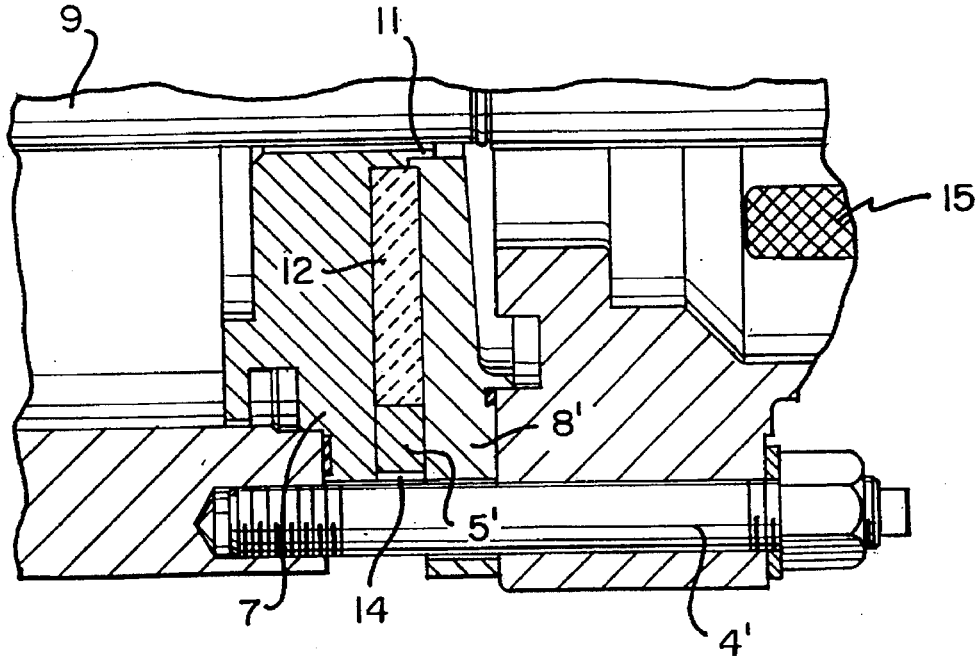
FIG. 2 illustrates a partial cross-sectional view of a heat barrier having mounting hardware extending through the ceramic element in accordance with the present invention.

Referring now to FIG. 2, another embodiment of a motor driven pump assembly according to the present invention is illustrated. The motor driven pump of FIG. 2 is substantial similar to that of FIG. 1, with the exception that a ceramic element 5' is provided with openings 14 through which the mounting hardware 4' extends. The contact surface between the heat barrier components 7' and 8' and the ceramic element 5' is larger than that of the pump assembly of FIG. 1. Openings 14 are preferably dimensioned such that there is no contact between ceramic element 5' and mounting hardware 4' whereby the ceramic element 5' is exposed to pressure only. Further, the adjoining surfaces of ceramic element 5' are dimensioned to have appropriate transitional radii which prevent undesirable peripheral pressures.

Referring once again to FIG. 1, ceramic element 5 is preferably configured as a circular ring. When utilizing a single-piece ceramic element 5, it necessary to build the heat barrier in two sections. It is noted that ceramic element 5 may also be configured as a multi-part element. For example, a segmented design would allow for the use of a one-piece heat barrier. Appropriate shapes and dimensions of the individual segments make it possible to assemble in each application the appropriate ceramic element 5 for heat barriers of various sizes. Further, the high insulating factor of the ceramic element 5 permits it to have a minimized axial length which shortens the overall axial length of the pump assembly. It is to be appreciated that as the length of the pump assembly is shortened, a positive effect on the dynamic properties of shaft 9 results which extends through heat barrier 3 and any associated components. For example, an impeller (not shown) in pump section 1, which may, for example, be connected to shaft 9 with a taper-bore-overhung connection, will run significantly better due to the short overhang of shaft 9. Therefore, the motor driven pump assembly according to the present invention will not require a third radial bearing which is required in prior art pump assemblies.

It is also to be appreciated that by positioning the insulating ceramic element 5 in the straight-line flux of force 6 between the mutually connected structural sections of the pump assembly, a rigid, solid structure for the overall pump system is provided, while simultaneously offering better thermal insulation between the motor and the pump. In particular, ceramic elements 5 fabricated of material from the zirconium oxide group, provides favorable stress patterns because their coefficient of expansion is comparable to that of the ferrous materials used for the heat-barrier components. Therefore, stress patterns which would otherwise result from diverging expansion factors, do not occur in the present invention. Of course, other ceramic materials can be used as well, in which case conventional means must be employed to compensate for different coefficients of expansion.

Figure 3:
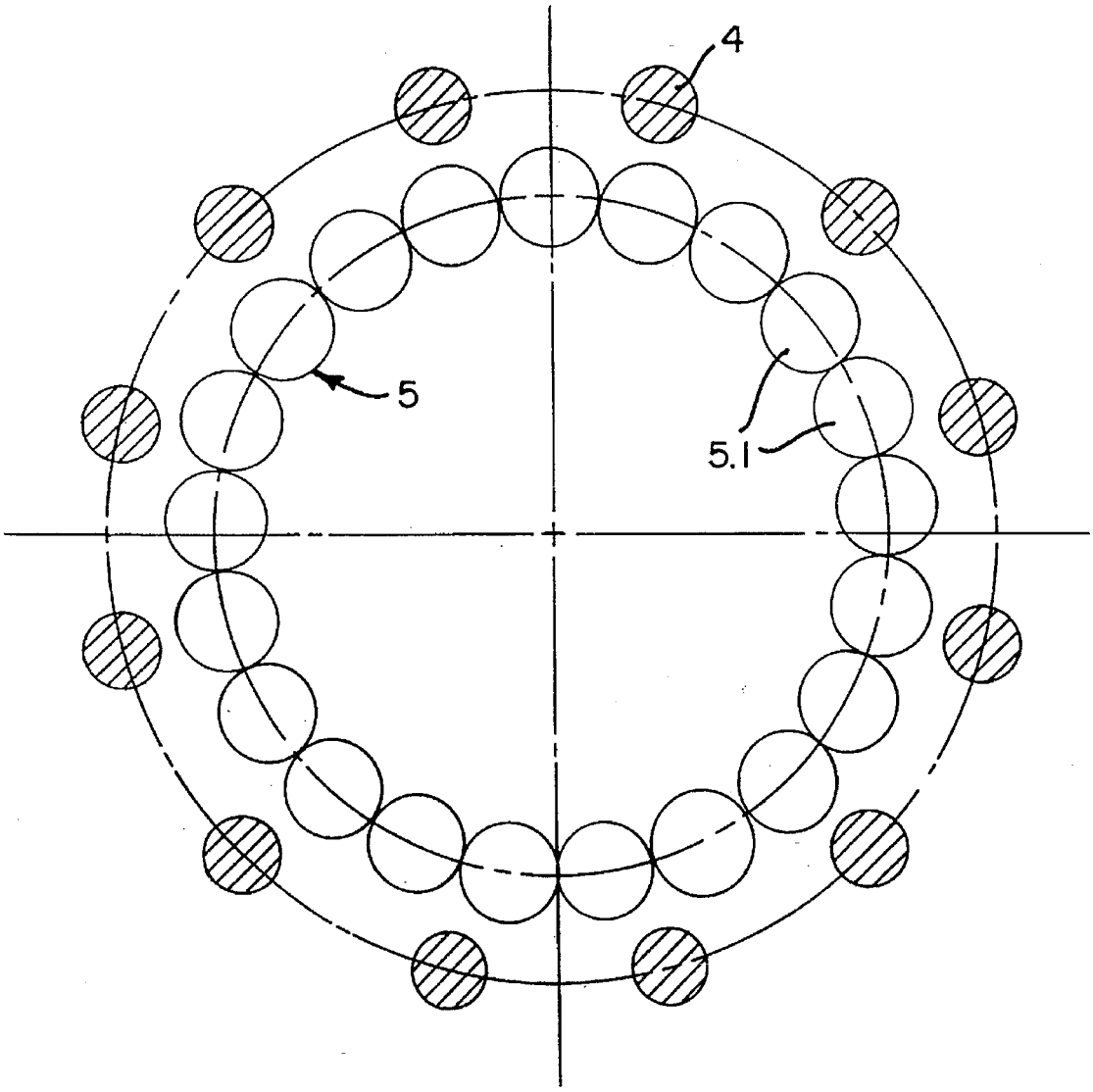
FIG. 3 illustrates a multi-part ceramic element.

Referring now to FIG. 3, a variation of a multi-part ceramic element 5 is illustrated. This variation includes a plurality of small individual ceramic elements 5.1 being tightly retained in one of the heat barrier components 7,8 to reduce the cost of manufacture. Ceramic elements 5.1 must be configured such that they can be installed evenly and tightly together, which requires precise matching of the outside dimensions of the ceramic elements 5.1 to the diameter of the space in which ceramic elements 5.1 are to be installed.

Figure 4:
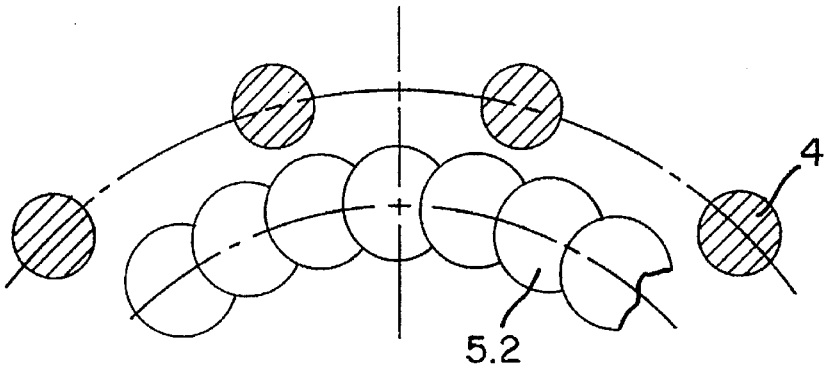
FIGS. 4–6 illustrate various embodiments of the multi-part ceramic element of FIG. 3.
Figure 5:
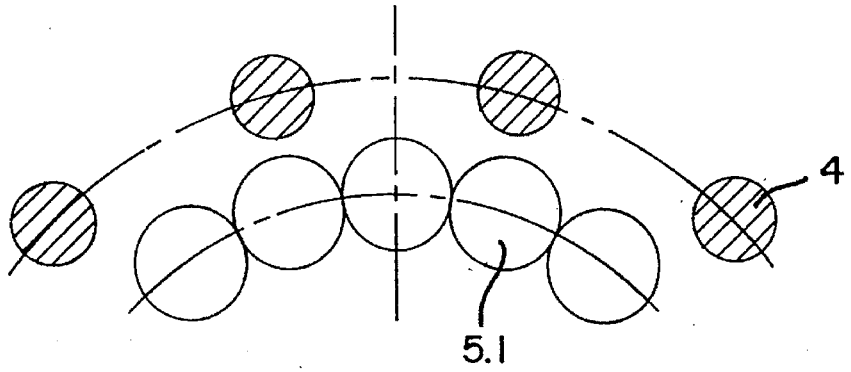
Figure 6:
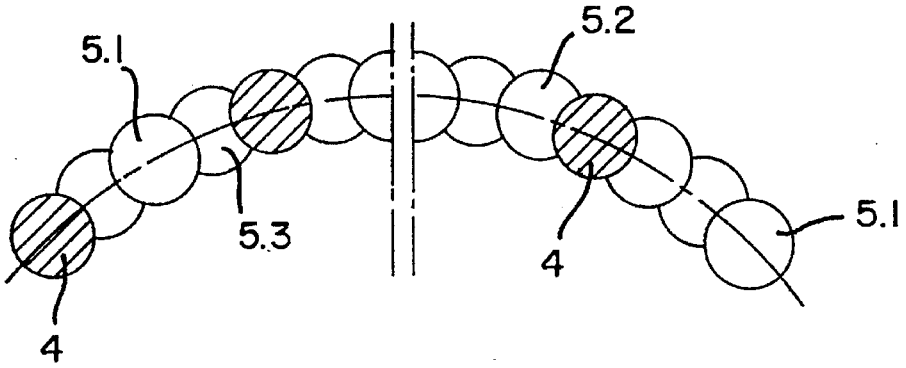

Thus, by utilizing a small selection of shapes of ceramic elements, it is possible to produce composite elements for a wide range of diameters. As shown in FIGS. 4–6, a combination of different shapes of ceramic elements 5.1, 5.2 and 5.3, may be used. It is to be appreciated that the round and crescent-shaped elements are illustrative examples only, and that other shapes, ranging from trapezoid to linear, may be utilized to permit the formation of an annular ceramic element 5 in a multi-part configuration. For example, numerous different shapes of multi-part ceramic elements are illustrated in FIGS. 4–6.

In accordance with the present invention, when forming multi-part ceramic elements 5, it is simple to determine which shape and size of a ceramic element 5.1–5.3 is best suited to a prescribed range of diameters. Reference to a range of diameters and to annular configurations does not, however, restrict the applicability of this invention to circular designs. The circumferential shape of an annular single or multi-part ceramic element may, of course, be non-circular (e.g., elliptic, rectangular, polygonal or any other shape, form or positional arrangement).

An annular multi-part ceramic element 5 can also be formed by stringing together relatively smaller ceramic elements 5.1–5.3 having varying contours. As shown in FIGS. 4 and 5, the small ceramic elements 5.1, 5.2 are preferably tailored to diameter ranges smaller than the diameter range containing mounting elements 4. If appropriately selected and configured, the small ceramic elements 5.1–5.3 also allow the assembly of a multi-part ceramic element 5 having larger diameters. Referring to FIG. 6, this can be accomplished by positioning small crescent-shaped ceramic elements 5.2 on either side of the mounting elements 4. To produce a large-area array of ceramic elements it is possible to integrate into a multi-part ceramic element 5 a number of double concave or biconvex ceramic elements 5.3 to serve as adapters between the other elements.

Having described the presently preferred exemplary embodiments of a centrifugal pump system in accordance with the present invention, it is believed that other modifications, variations and changes will be suggested to those skilled in the art in view of the teachings set forth herein. It is, therefore, to be understood that all modifications, variations and changes are believed to fall within the scope of the present invention without departing from the spirit and scope of the invention as disclosed above.

What is claimed is:

1. A centrifugal pump system for moving hot media, comprising:

a pump section;

a motor section;

mounting elements holding the pump and motor sections together thereby creating a force that is transmitted between the pump section and the motor section; and a heat barrier positioned between the pump section and the motor section, said heat barrier including an insulating ceramic element, said force transmitted between the pump section and the motor section being transferred through said ceramic element.

2. The centrifugal pump system as recited in claim 1, wherein said ceramic element is a one-piece element.

3. The centrifugal pump system as recited in claim 1, wherein said ceramic element is a multi-part element.

4. The centrifugal pump system as recited in claim 1, wherein said ceramic element has an annular shape.

5. The centrifugal pump system as recited in claim 4, further comprising a shaft extending between said pump section and said motor section, a ceramic insulating material being disposed between said shaft and said ceramic element.

6. The centrifugal pump system as recited in claim 5, further comprising a first heat barrier component disposed between said pump section and said ceramic element and a second heat barrier component disposed between said motor section and said ceramic element, said first heat barrier component and said second heat barrier component being in heat conducting contact to form a thin-walled, pressure resistant, gas-impermeable passage.

7. The centrifugal pump system as recited in claim 6, whereto said ceramic insulating material is disposed between said passage and said ceramic element.

8. The centrifugal pump system as recited in claim 7, wherein said ceramic element has a plurality of openings for accepting a plurality of mounting elements, said openings extending coaxial to said shaft.

9. The centrifugal pump system as recited in claim 6, wherein said thin-walled, pressure resistant, gas-impermeable passage is disposed solely in an area adjacent to said shaft.

10. The centrifugal pump system as recited in claim 1, wherein said ceramic element is fabricated of a ceramic material selected from the group consisting of zirconium oxides.

11. The centrifugal pump system as recited in claim 7, wherein said ceramic element is fabricated of a ceramic material selected from the group consisting of zirconium oxides.

12. The centrifugal pump system as recited in claim 9, wherein said ceramic element is fabricated of a ceramic material selected from the group consisting of zirconium oxides.

13. The centrifugal pump system as recited in claim 1, wherein said heat barrier is devoid of external and internal cooling.

* * * * *

UNITED STATES PATENT AND TRADEMARK OFFICE

CERTIFICATE OF CORRECTION

PATENT NO. : 5,626,460

DATED : May 6, 1997

INVENTOR(S) : Hans-Joachim FRANKE et al.

It is certified that error appears in the above-indentified patent and that said Letters Patent is hereby corrected as shown below:

Title page, [75], Inventors, following the name of Roland Lachmayer, change "Braunschweig" to --Bad Sassendorf--.

Signed and Sealed this

Twenty-first Day of October 1997

*Attest:*

BRUCE LEHMAN

*Attesting Officer*

*Commissioner of Patents and Trademarks*